US009254419B2

(12) United States Patent
Xin

(10) Patent No.: US 9,254,419 B2
(45) Date of Patent: Feb. 9, 2016

(54) UNDERWATER MAN-POWERED MECHANICAL PROPELLER

(71) Applicant: Zhanluo Xin, Tianjin (CN)

(72) Inventor: Zhanluo Xin, Tianjin (CN)

( * ) Notice: Subject to any disclaimer, the term of this patent is extended or adjusted under 35 U.S.C. 154(b) by 0 days.

(21) Appl. No.: 14/366,263

(22) PCT Filed: Dec. 27, 2012

(86) PCT No.: PCT/CN2012/087725

§ 371 (c)(1),
(2) Date: Jun. 18, 2014

(87) PCT Pub. No.: WO2013/104259

PCT Pub. Date: Jul. 18, 2013

(65) Prior Publication Data

US 2014/0338583 A1 Nov. 20, 2014

(30) Foreign Application Priority Data

Jan. 12, 2012 (CN) ..... 2012 1 0008991

(51) Int. Cl.

| | |
|---|---|
| ***A63B 35/08*** | (2006.01) |
| ***A63B 35/10*** | (2006.01) |
| ***A63B 35/00*** | (2006.01) |
| ***B63H 16/00*** | (2006.01) |
| ***B63H 16/08*** | (2006.01) |
| ***B63H 5/07*** | (2006.01) |

(52) U.S. Cl.

CPC *A63B 35/10* (2013.01); *B63H 5/07* (2013.01); *B63H 16/08* (2013.01)

(58) Field of Classification Search

CPC ..... A63B 35/10; A63B 31/08; A63B 31/10; A63B 31/11; A63B 35/00; A63B 35/08; B63H 5/07; B63H 15/08

USPC ..... 441/55, 56, 59, 60, 61; 440/22, 21, 26, 440/31, 32; 114/315

See application file for complete search history.

(56) References Cited

U.S. PATENT DOCUMENTS

| | | | | | |
|---|---|---|---|---|---|
| 1,324,687 | A | * | 12/1919 | Newby | B63H 16/14 440/32 |
| 4,289,487 | A | * | 9/1981 | Fattler | A63B 35/10 440/31 |
| 4,321,048 | A | * | 3/1982 | Marchese | B63H 16/14 440/31 |

* cited by examiner

*Primary Examiner* — Anthony Wiest

(74) *Attorney, Agent, or Firm* — George G. Wang; Bei & Ocean

(57) ABSTRACT

An underwater man-powered mechanical propeller includes a screw propeller arranged on a screw propeller shaft and encircled by a concentric protective ring. One side of the protective ring is provided with a supporting plate on which a first gear and a second gear mesh with each other, and a transitional gear and the second ear form a meshing pair. The drive shaft of the transitional gear passes through the supporting plate and has a second bevel gear, which meshes with a first bevel gear provided on the screw propeller shaft. The first gear is connected to a first connecting rod and the second gear is connected to a second connecting rod.

2 Claims, 2 Drawing Sheets

UNDERWATER MAN-POWERED MECHANICAL PROPELLER

FIELD OF THE INVENTION

The present invention relates to an auxiliary appliance for swimming, and more particularly, relates to an underwater man-powered mechanical propeller for increasing the swimming speed.

BACKGROUND OF THE INVENTION

Presently, in addition to bare-handed swim without any appliance, wearing swim fins on the feet for speeding up is another way to swim. However, both ways expend huge physical energy and have low swim speed, and therefore, they cannot keep swimming for a long time.

SUMMARY OF THE INVENTION

The present invention is intended to solve the defects of the existing swimming ways, and thereby provides an underwater man-powered mechanical propeller by using the mechanical drive principle to convert the physical power into high-efficiency driving motion powers.

The underwater man-powered mechanical propeller according to the invention includes a screw propeller arranged on a screw propeller shaft, the screw propeller is provided with a first bevel gear arranged at the back part thereof, and is provided with a concentric protective ring on the outer side thereof; one side of the protective ring is provided with a supporting plate; the supporting plate is provided with a first gear and a second gear meshed with each other, and a transitional gear is also arranged thereon and forms a meshing pair together with the second gear; the drive shaft of the transitional gear penetrates through the supporting plate, and one end thereof located in the protective ring is provided with a second bevel gear which forms a meshing pair together with the first bevel gear. The first gear is connected to a first connecting rod, while the second gear is connected to a second connecting rod; and the screw propeller shaft is provided with a one-way flywheel thereon.

The first gear and the second gear can be segment gear.

The beneficial effects of the present invention are as follows:

A. The propeller has novel and compact structure, and is easy and simple to use;

B. The propeller realizes a high swim speed without excessive consumption of physical energy, and a swimmer can keep swimming a long time by using it.

DETAILED DESCRIPTION OF THE INVENTION

To further understand the technical solution of the present invention, various embodiments of the invention are illustrated below in conjunction with accompanied drawings.

Figure 1:
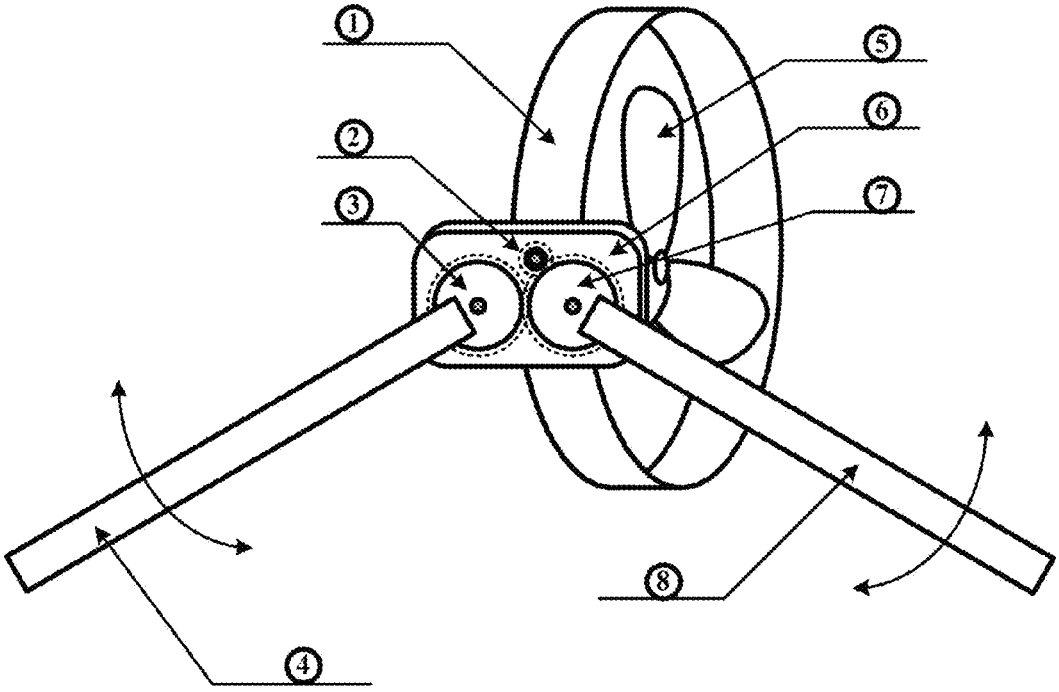
FIG. 1 shows a schematic view of the present invention.
Figure 2:
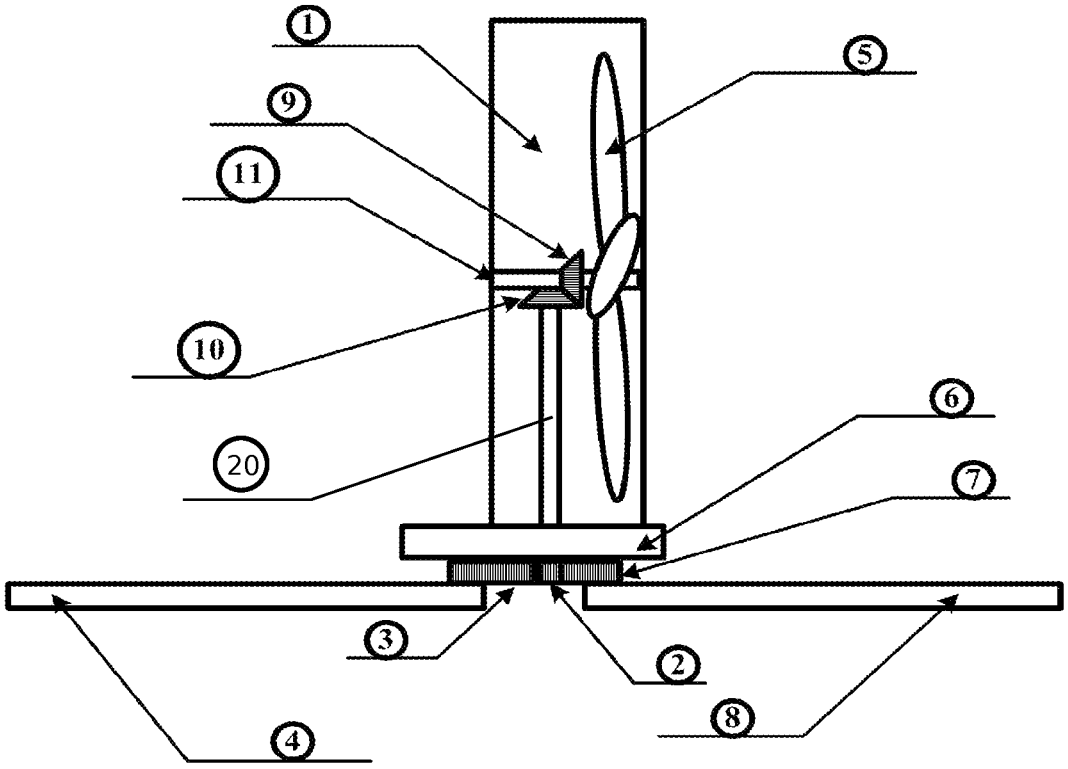
FIG. 2 shows a top plan view of FIG. 1.

Referring to the FIG. 1 and FIG. 2, an underwater man-powered mechanical propeller of the present invention includes: a protective ring 1, a transitional gear 2, a first gear 3, a first connecting rod 4, a screw propeller 5, a supporting plate 6, a second gear 7, a second connecting rod 8, a first bevel gear 9, a second bevel gear 10 and a screw propeller shaft 11.

The screw propeller 5 is arranged on the said screw propeller shaft 11; the screw propeller 5 is provided with the first bevel gear 9 which is coaxially arranged on the shift, and the screw propeller 5 is provided with a concentric protective ring encircling therearound; one side of the protective ring 1 is provided with the supporting plate 6; the supporting plate 6 is provided with the first gear 3 and the second gear 7 and the transitional gear 2; wherein the second gear 7 forms a meshing pair together with the first gear 3 and the transitional gear 2 respectively. The second bevel gear 10 is arranged on the drive shaft 20 of the transitional gear 2, the drive shaft 20 penetrates through the supporting plate 6, and the axis of the drive shaft and the axis of the screw propeller shaft 11 form a 90-degree angle, thereby achieving the mechanical diversion via the bevel gear 9 meshing with the second bevel gear 10. The first connecting rod 4 connects with the first gear 3, and drives the first gear 3 to rotate via reciprocating swinging; the second connecting rod 8 connects with the second gear 7, and drives the second gear 7 to rotate via reciprocating swinging.

The first connecting rod 4 and second connecting rod 8 drive the first gear 3 and the second gear 7 respectively in a specific angle range when reciprocating swinging, therefore, the first gear 3 and the second gear 7 can be segment gear respectively for saving material and reducing the weight of the propeller.

To prevent driving the screw propeller 5 to reverse turning when bending the knees, the screw propeller shaft 11 of the present invention is provided with a one-way flywheel thereon (not shown in the figures).

By arranging the transitional gear 2, it achieves speeding up via meshing the transitional gear 2 with the second gear 7, it also transmits the power to the second bevel gear 10 via the drive shaft of the transitional gear 2, and achieves diversion via the first bevel gear 9 meshing with the second bevel gear 10, and transmits the power to the screw propeller 5 simultaneously.

The propeller of the present invention should use in pairs, and the operation principle and the using method are as follows:

(1) Using straps to band the first connecting rod 4 on the shank of human leg, and band the second connecting rod 8 on the thigh, and arranging the screw propeller 5 at the outer side of the knee joint;

(2) When bending the shank and the thigh of the human leg, the first connecting rod 4 and the second connecting rod 8 are formed a small angle;

(3) When stretching the shank and the thigh of the human leg from bending state, the angle between the first connecting rod 4 and the second connecting rod 8 are increased accordingly, thus driving the first gear 3 connected with the first connecting rod 4 and the second gear 7 connected with the second connecting rod 8 meshing, and then driving the power onto the drive shaft of the transitional gear 2 via meshing the second gear 7 and the transitional gear 2; then the second bevel gear 10 meshing with the first bevel gear 9 of the screw propeller shaft 11 to drive the screw propeller 5 to rotate, thus propelling the human moving forwardly;

(4) When bending the shank and the thigh of the human leg from the stretching state, the angle between the first connecting rod 4 and the second connecting rod 8 are decreased accordingly; a one-way flywheel is arranged on the present invention to avoid driving the screw propeller 5 rotating, thus the reverse turning is prevented;

(5) Repeating the movement (3) and (4) to realize increasing the swimming speed through the underwater man-powered mechanical propeller.

The underwater man-powered mechanical propeller utilizes the mechanical drive principle to convert the physical power into high-efficiency driving motion powers, and overcomes the defects of lacking the ways for increasing the swim speed, thus realizing a high swim speed without excessive consumption of physical energy and having a practical value.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

What is claimed is:

1. An underwater man-powered mechanical propeller, comprising a screw propeller shaft having a one-way flywheel thereon, a screw propeller arranged on the screw propeller shaft, a first bevel gear on the screw propeller shaft, a concentric protective ring encircling the screw propeller, a supporting plate on one side of the protective ring, a first gear and a second gear meshed with each other on the supporting plate, a transitional gear forming a meshing pair together with the second gear on the supporting plate with a drive shaft of the transitional gear passing through the supporting plate, and a second bevel gear provided at one end of the drive shaft which forms a meshing pair together with the first bevel gear; wherein the first gear is connected to a first connecting rod, and the second gear is connected to a second connecting rod.

2. The underwater man-powered mechanical propeller according to claim 1, wherein the first gear and the second gear can be segment gear.

* * * * *